US008512163B2

(12) United States Patent
McDowell et al.

(10) Patent No.: US 8,512,163 B2
(45) Date of Patent: Aug. 20, 2013

(54) DIVOT CADDY

(76) Inventors: Ulysses McDowell, Charlotte, NC (US); Larry McDowell, Hanover, MD (US)

( * ) Notice: Subject to any disclaimer, the term of this patent is extended or adjusted under 35 U.S.C. 154(b) by 326 days.

(21) Appl. No.: 13/046,759

(22) Filed: Mar. 13, 2011

(65) Prior Publication Data

US 2012/0115629 A1 May 10, 2012

Related U.S. Application Data

(60) Provisional application No. 61/410,025, filed on Nov. 4, 2010.

(51) Int. Cl.
*A63B 55/10* (2006.01)
*A63B 57/00* (2006.01)

(52) U.S. Cl.
USPC ..... 473/282; 473/285; 473/286; 473/408

(58) Field of Classification Search
USPC ..... 473/282, 285, 286, 408
See application file for complete search history.

(56) References Cited

U.S. PATENT DOCUMENTS

| | | | | |
|---|---|---|---|---|
| 5,116,046 | A * | 5/1992 | Pace | 473/286 |
| 5,226,647 | A | 7/1993 | Notarmuzi | |
| 5,393,052 | A | 2/1995 | Kennedy | |
| 5,529,299 | A | 6/1996 | Bellagamba | |
| 5,643,114 | A * | 7/1997 | Marcus | 473/408 |
| 5,706,831 | A | 1/1998 | Whitbeck | |
| 5,733,208 | A * | 3/1998 | Fazekas | 473/406 |
| 5,788,197 | A * | 8/1998 | Tutela | 248/156 |
| 6,033,322 | A * | 3/2000 | England | 473/408 |
| 6,050,905 | A * | 4/2000 | Tate | 473/408 |
| 6,290,617 | B1 * | 9/2001 | Cole et al. | 473/408 |
| 6,893,357 | B1 * | 5/2005 | Bennett | 473/282 |
| 6,994,639 | B2 | 2/2006 | Parks et al. | |
| 7,654,920 | B2 * | 2/2010 | Perry | 473/408 |
| 2005/0037873 | A1 * | 2/2005 | Kennedy | 473/408 |
| 2008/0153631 | A1 * | 6/2008 | Mazetta | 473/408 |
| 2011/0207558 | A1 * | 8/2011 | Huffman | 473/406 |

* cited by examiner

*Primary Examiner* — Stephen L. Blau
(74) *Attorney, Agent, or Firm* — Daniel Boudwin

(57) ABSTRACT

A golfing accessory having a golf club handle holder, a divot repair tool, and a golf ball marker retainer. The accessory has a pair of prongs attached to each end of its body. The first end having prongs that form a U-shape adapted to cradle a golf club handle. The opposite end of the accessory has a second set of prongs attached thereto that form a V-shape, divot repair tool. When the second end of the accessory is planted into the ground, a collapsible stand may be extended and a golf club handle may be laid upon the device to provide a stable way to hold the club aloft above the soil. The middle portion of the accessory's body contains a round cut-out for storing a golf ball marker of predetermined size and shape. This cut-out is lined with a magnetic material to facilitate retention of a marker.

6 Claims, 1 Drawing Sheet

DIVOT CADDY

CROSS REFERENCE TO RELATED APPLICATION

This application claims the benefit of U.S. Provisional Application No. 61/410,025 filed on Nov. 4, 2010, entitled "Divot Caddy"

BACKGROUND OF THE INVENTION

1. Field of the Invention

The instant invention relates to a golfing accessory that has a cradle for holding the handle of a golf club at one end of the accessory, a divot repair tool at the opposite end, and holder for temporary retention of a golf ball marker.

2. Description of the Prior Art

The game of golf has numerous customary nuances of play that require golfers to perform a variety of actions. Clubs are placed beside a golfer but off the ground to avoid moisture on the handle which can affect proper swing, balls are removed from the course and replaced with a flat circular marker to avoid disturbing the strokes of other players, holes in the course caused by strokes or golf equipment must be repaired by the player, and similar actions taken. Over the years golfers have developed devices to facilitate these actions with greater ease and convenience to the players. For instance, tools have been created to hold a golf club while not in use, hold ball markers, repair divot holes in the golf course, and clean dirt from golf equipment. Golfing accessories such as these are known in the art and have familiar design and structural elements. Numerous devices of varying design are disclosed by the prior art for the purposes of club holding, divot repair, and ball marker holing. Some devices are used for only a single task while others are adapted to work as multi-purpose tools.

Kennedy, U.S. Pat. No. 5,393,052 discloses a combination divot repair, club holder, and ball marker holder.

Bellagamba, U.S. Pat. No. 5,529,299 discloses a combination club holder, divot repair tool, and ball marker.

These devices do not address the problem of stabilizing the golf club holder in varying terrain conditions, or providing an attractive quality to the ball marker holder to improve retention. The present invention relates to a new and improved golfing accessory for holding a golf club steady on moist ground, repairing divot holes, and removably retaining a golf ball marker. It substantially diverges in design elements from the prior art and consequently it is clear that there is a need in the art for an improvement to the existing golfing devices for club handling, divot repair, and ball marker retention. In this regard the instant invention substantially fulfills these needs.

SUMMARY OF THE INVENTION

A multi-tool golfing accessory device is disclosed having a cradle for the handle of a golf club, a divot repair tool, and a recess for retaining a golf ball marker. The body of the device has a set of prongs at each end of the main shaft. The first set of prongs is attached to the first end of the main shaft and has a U-shape which forms a cradle for a golf club handle. The opposite end of the device has a set of prongs attached thereon having a V-shape and forming a tool for repairing divots in the turf of a golf course. When the prongs on the second end of the device are pushed into the ground the handle of a golf club may be set upon the U-shaped cradle of the first end to hold the handle and shaft of the golf club off the ground of the course.

The main body of the accessory has a round recess cut out of it forming a holder for a golf ball marker. The recess has a predetermined size and shape to allow the ball marker to be easily inserted in and removed from the device. The back side of the main shaft portion has a collapsible stand for the device and at least two legs attached by a hinge. When the stand is extended the legs are pushed into the ground with the prongs of the second end to make the golf club holder stable in moist ground.

Other objects, features and advantages of the present invention will become apparent from the following detailed description taken in conjunction with the accompanying drawings.

BRIEF DESCRIPTIONS OF THE DRAWINGS

The invention will be better understood when consideration is given to the "Detailed Description of the Invention" set forth below. This description makes use of the attached figures wherein.

The same reference numbers correspond to the same parts of the invention throughout the different figures.

DETAILED DESCRIPTION OF THE INVENTION

Figure 1:
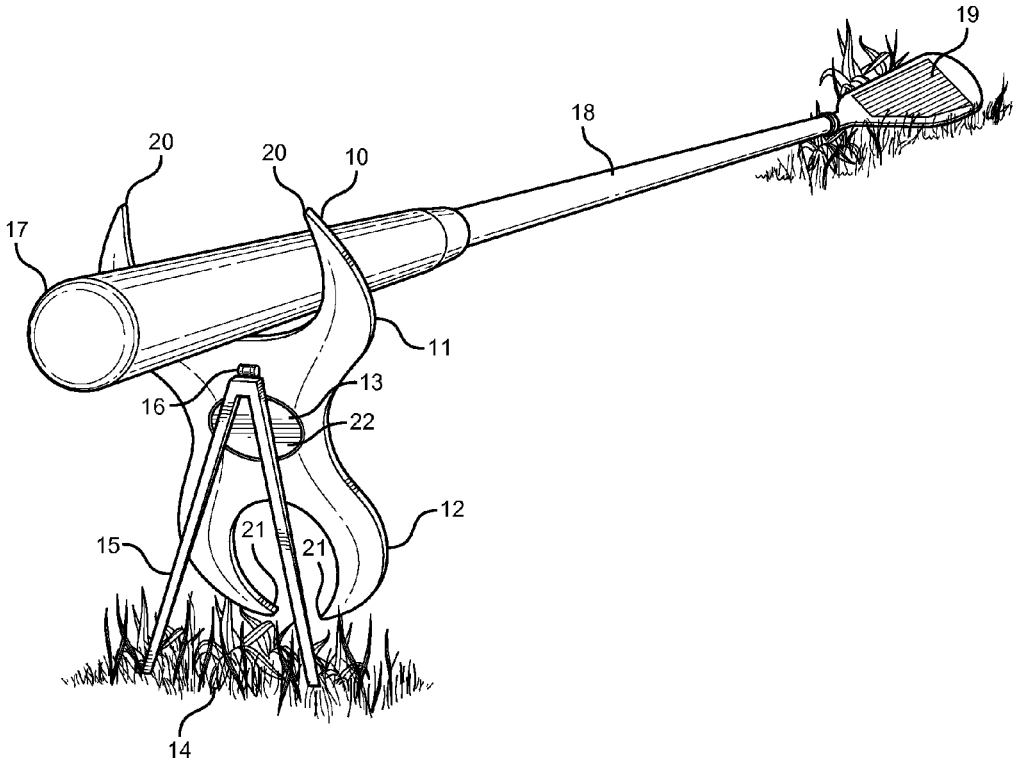
FIG. 1 is the preferred embodiment of the new and improved golfing accessory for golf club holding, divot repair, and ball marker retention.
Figure 2:
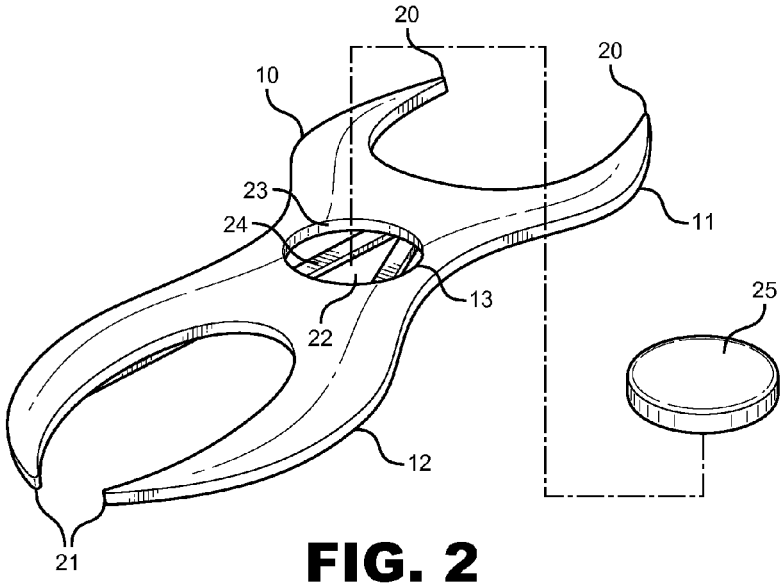
FIG. 2 is a perspective illustration of the device of FIG. 1 with the ball marker removed from its recess.

With reference now to the drawings and in particular to FIGS. 1 & 2 thereof, the new and improved golf club holder/divot repair tool/ball marker holder embodying the concepts of the present invention will be described.

Referring now to FIGS. 1 & 2, there is shown the golfing accessory 10 which comprises a club golf club handle holder component 11, a divot repair tool component 12, and a round recess used for ball marker retention 13. These components are fabricated together in one piece to achieve the intended objectives. The device is shown planted in the ground 14 whereby the prongs of the divot repair tool 12 are supported by the soil 14 and the golf club handle cradle 11 is upright.

FIG. 1 shows the collapsible stand 15 of the device, attached thereto by a hinge 16 on the back of the golfing accessory, in an extended position to provide additional stability when the device is inserted into the ground 14. The preferred embodiment having at least two leg portions comprising said stand 15. A golf club having a handle 17, a shaft 18, and a club head 19 is laid upon the device 10 with the golf club handle 17 resting in the golf club handle cradle 11 which holds the club handle 17 and shaft 18 up off the ground 14.

A pair of prongs 20 on the top end of the golfing accessory 10 have a U-shaped surface between them, adapted to fit the size of a golf club handle 17 and thus form the golf club handle holder 11. On the opposite end of the device 10 a second set of prongs contains a V-shaped surface therebetween forming the divot repair tool 12. The ball marker retention portion 13 of the device 10 is formed by a round recess 22 cut-out from the portion of the device 10 conjoining the club handle holder 11 and the divot repair tool 13, and has a predetermined size and shape.

In one embodiment the device 10 is made of plastic or a non-magnetic metal and the inside edge 23 of the round recess 22 is coated with a magnetic material to provide an attractive quality to a metal ball marker 25 and to increase the strength of retention. FIG. 2 shows a portion of the golf accessory stand 15 viewable through the round recess 22, this portion 24 of the stand 15 being coated with the same magnetic material as the inside edge 23 of the ball marker recess 22 to further increase retention of a ball marker 25. Alternatively the stand 22 itself can be constructed of the aforementioned magnetic material. In a third embodiment of the invention, the device 10 may be constructed entirely of a magnetic metal. When the stand 15 is extended as in FIG. 1, the ball marker 25 can be released from the ball marker retainer 13 by pushing it outward from either side of the golfing accessory 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim the following:

1. A golfing accessory for holding a golf club off the ground, repairing divots in a golf course turf, and holding a golf ball marker comprising;

an elongated main shaft portion having a first end and a second end connected by a middle portion, wherein each of said first and second end has two inwardly curved prongs, said first end having a U-shape and being adapted to cradle a handle of a golf club, said middle portion having a round cutout removably retaining a ball marker, said second end being positioned along said elongated main shaft opposite said first end and having a V-shape and being adapted to repair divot holes in the ground, and wherein said main shaft portion having a front and back portion, said back portion hingedly attaches to a collapsible stand, and said stand comprising at least two legs.

2. The golfing accessory of claim 1 wherein:

said golfing accessory is constructed of a magnetic metal.

3. The golfing accessory of claim 1 wherein:

said golfing accessory is constructed of metal.

4. The golfing accessory of claim 3 wherein:

said round cutout is lined with a ring of magnetic material.

5. The golfing accessory of claim 4 wherein:

said stand is constructed of a magnetic material.

6. The golfing accessory of claim 4 wherein:

a portion of said stand viewable through said round cutout when said stand is collapsed against said back portion being coated with a magnetic material.

* * * * *